United States Patent [19]

Imanishi

[11] 4,149,400

[45] Apr. 17, 1979

[54] DIE CHANGE DEVICE IN A TRANSFER PRESS

[75] Inventor: Shozo Imanishi, Sagamihara, Japan

[73] Assignee: Aida Engineering, Ltd., Japan

[21] Appl. No.: 866,954

[22] Filed: Jan. 5, 1978

[30] Foreign Application Priority Data

Apr. 28, 1977 [JP] Japan ..... 52/48410

[51] Int. Cl.[2] ..... B21D 43/10

[52] U.S. Cl. ..... 72/421

[58] Field of Search ..... 72/421, 405, 404

[56] References Cited

U.S. PATENT DOCUMENTS

| | | | |
|---|---|---|---|
| 3,105,399 | 10/1963 | Strugala | 72/405 |
| 3,995,470 | 12/1976 | Kamelander | 72/421 |
| 4,024,749 | 5/1977 | Taniguchi | 72/421 |
| 4,038,862 | 8/1977 | Yamashita | 72/421 |

*Primary Examiner*—C. W. Lanham
*Assistant Examiner*—Gene P. Crosby
*Attorney, Agent, or Firm*—Holman & Stern

[57] ABSTRACT

A die change mechanism in a transfer press is disclosed for carrying feed bars with dies supported thereon into and out of the press. The mechanism performs cyclic clamping, advancement, unclamping and return movements on the feed bars which feed work pieces to and through the successive processing stages of the press.

1 Claim, 14 Drawing Figures

DIE CHANGE DEVICE IN A TRANSFER PRESS

BACKGROUND OF THE INVENTION

This invention relates to a die change device in a transfer press.

Hithertofore, the die change operation in a transfer press has been usually performed by manually carrying feed bars out of and into the press. However, such manual die change operation is unsatisfactory from the view point of safety and operation efficiency.

SUMMARY OF THE INVENTION

Therefore, the purpose of the present invention is to provide a die change device which is capable of carrying feed bars together with dies supported thereon out of and into a transfer press to thereby eliminate the disadvantages in the conventional manual die change operation and effect the die change operation efficiently and positively.

A transfer press with a die change device according to the invention has a number of successive processing stages and plural pairs of opposing or cooperating grip fingers on a pair of feed bars are adapted to feed workpieces to and through the successive processing stages to perform successive processing operations on the workpieces through the successive processing stages as the feed bars repeat the cycle of clamping, advancement, unclamping and return movements.

The above and other objects and attendant advantages of the present invention will be more readily apparent to those skilled in the art from a reading of the following detailed description in connection with the accompanying drawings which show one preferred embodiment of the invention for illustration purpose only, but not for limiting the scope of the same in any way.

BRIEF DESCRIPTION OF THE DRAWINGS

FIGS. 9A, 9B, 9C, 9D and 9E are side elevational views in longitudinal section showing the feed bar actuation mechanism in its different operative positions in which FIG. 9B shows the clamping position; FIG. 9C shows the unclamping position controlled by the cam; FIG. 9D shows the intermediate unclamping position; and FIG. 9E shows the fully open unclamping position.

PREFERRED EMBODIMENT OF THE INVENTION

Figure 1:
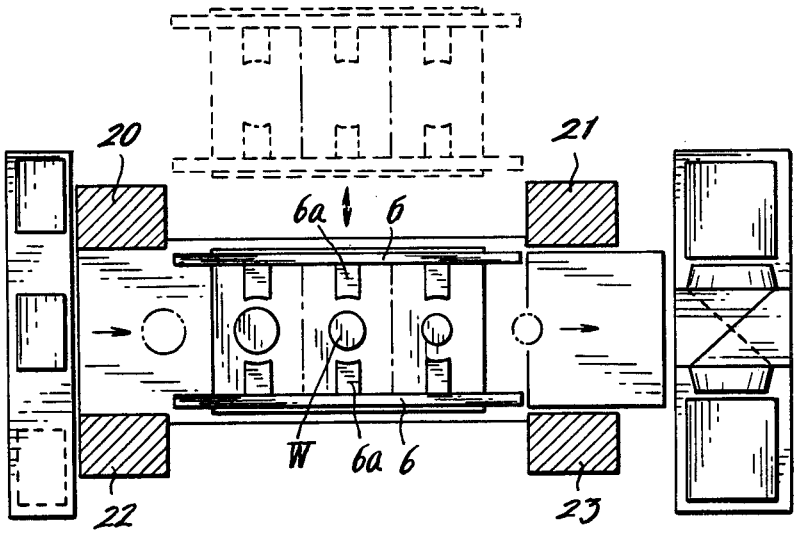
FIG. 1 is a schematic plan view of a transfer press in which the die change device of the present invention is incorporated.

The present invention will be now described referring to the accompanying drawings which show the preferred embodiment of the invention for illustration purpose only. In the drawings, reference numeral 1 denotes the crown on the framework of the transfer press, reference numeral 2 denotes the bracket integrally formed with the press framework, reference numeral 3 denotes the feed bar actuation lever, reference numeral 4 denotes the oil pressure cylinder mounted on the bracket 2, reference numeral 5 denotes the clamp cylinder, reference numeral 6 denotes the feed bars, reference numeral 7 denotes the positioning plates, reference numeral 8 denotes the feed bar carriers for advancing and returning the feed bars, reference numeral **8*a* denotes grooves formed in the feed bar carriers 8, reference numeral 9 denotes the magnets embedded in the feed bar carriers, reference numeral 10 denotes the slide of the transfer press, reference numeral 11 denotes the cam, reference numeral 12 denotes the roller mounted on the feed bar actuation lever, reference numeral 13 denotes the pin, reference numeral 14 denotes the connection rod, reference numeral 15 denotes the clamp drive unit connected to the lever 3 through the connection rod 14, reference numeral 16 denotes the clamp unit, reference numeral 17 denotes the rack, reference numeral 18 denotes the electromagnetic valve, reference numeral 19 denotes the electromagnetic valve, reference numeral 20 denotes the left-hand and rear column on the press framework, reference numeral 21 denotes the right-hand and rear column on the press framework, reference numeral 22 denotes the left-hand and front column, reference numeral 23 denotes the right-hand and front column, reference numeral 24 denotes the bead, reference numeral 25 denotes the bolster, reference numeral 26 denotes the transfer unit for imparting the advancement and return movements to the feed bars 6, reference numeral 27 denotes the drive pins for advancing and returning the feed bars 6, reference numeral 28 denotes the clamping and unclamping carriers for the feed bars 6, reference numeral 29 denotes dies, reference numeral 30 denotes the conveyors, reference numeral 31 denotes the lower die set plate, reference numeral 32 denotes the upper die set plate, reference numeral 34 denotes the bracket, reference numeral 35 denotes the gear in engagement with the rack 17, reference numeral 36 denotes the arm, reference numeral 37 denotes the eccentric pin, reference numeral 38 denotes the link, reference numeral 39 and 40 denote the racks, and reference numeral 41** denotes the gear.

Figure 3:
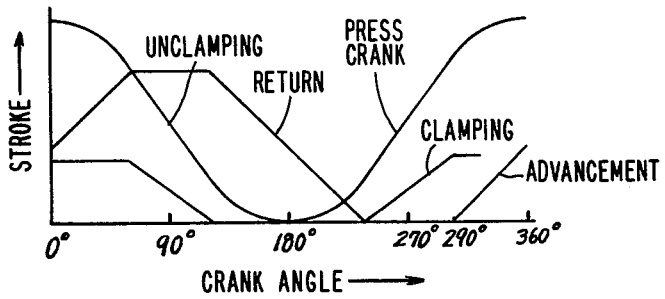
FIG. 3 is a graph which shows the relationship between the stroke of the press slide and the feed bars.
Figure 2:
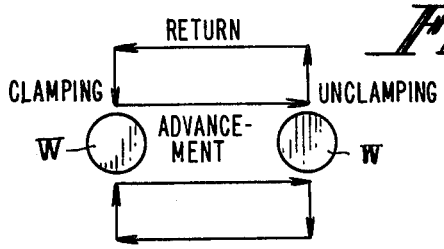
FIG. 2 is a diagram which shows the operation of the feed bars.
Figure 4:
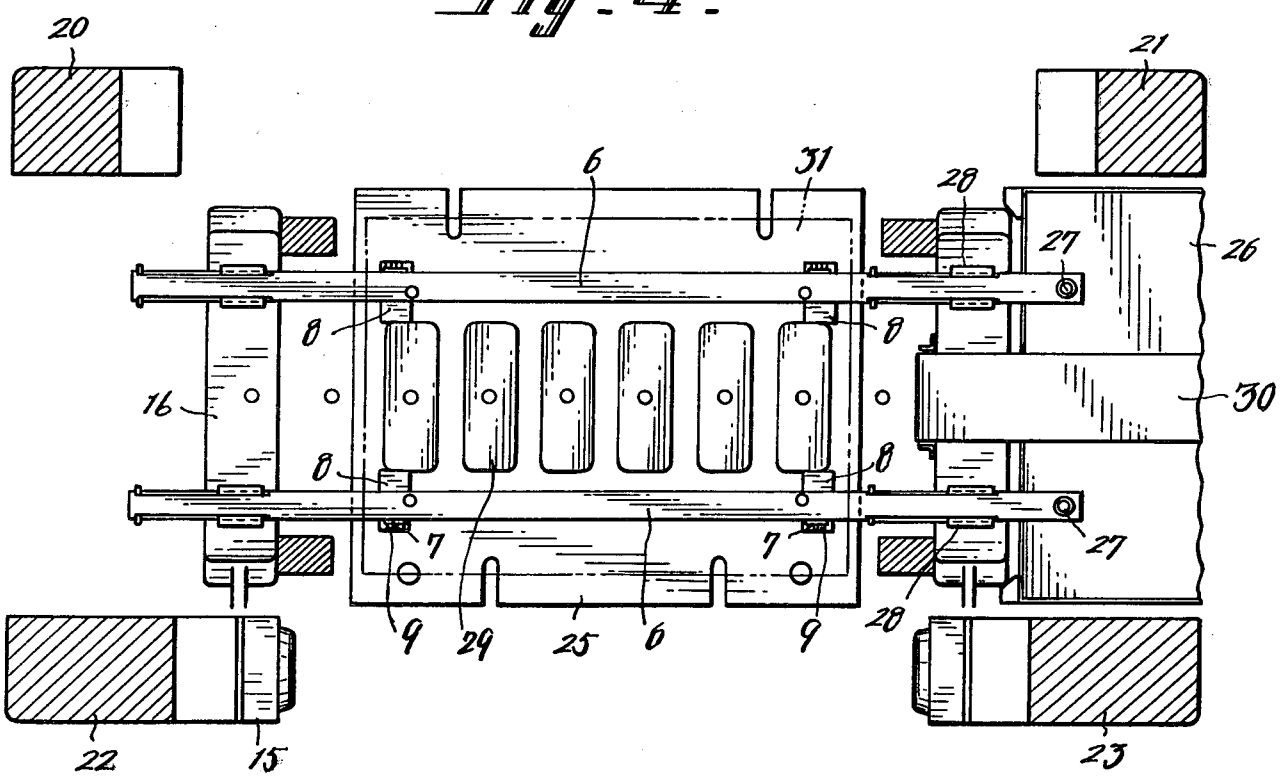
FIG. 4 is a fragmentary plan view on an enlarged scale of said transfer press as shown in FIG. 1.
Figure 5:
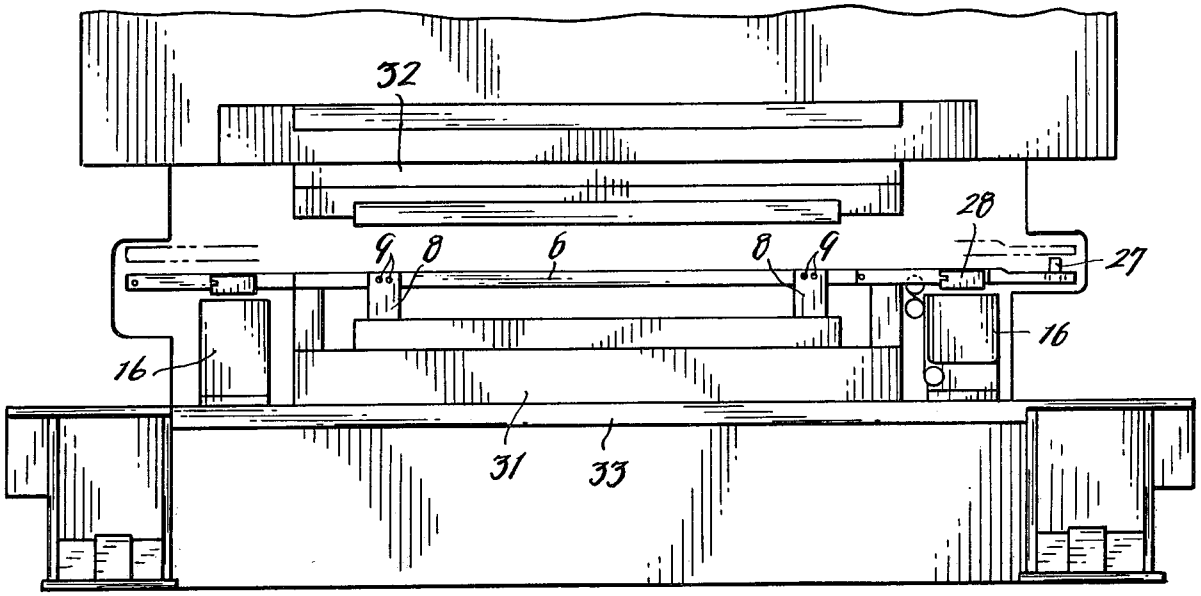
FIG. 5 is a front elevational view of the transfer press shown in FIG. 4.

The operation for removing dies out of the transfer press after the processing operations by the use of the dies have been completed will be now described stepwise. After the operations by the dies have been completed, the press slide 10 is moved to and set in a predetermined position. The feed bars 6, 6 are moved to the intermediate unclamping position as will be described hereinafter. The press slide 10 is moved to and set in a position adjacent to the bottom dead center of the stroke. The upper die clamper is released. The transfer press is disposed in the position of crank angle 290°. With the transfer press at this crank angle, since the feed bars 6, 6 are at rest prior to the commencement of advance movement (see FIG. 3), the position of the feed bar advancement and return drive pins 27 is precisely determined even when the rest angle of the press varies by a small amount and the slide 10 has moved upwardly to a position adjacent to the top dead center of the stroke. The feed bars are moved to the fully open unclamping position as will be described hereinafter. The lower die clamper is released. The upper and lower dies are lifted by the lifter (not shown). The feed bars 6 are also lifted as the upper and lower dies are lifted because the feed bars are carried on the feed bar carriers 8 which are in turn mounted on the lower die set plate 31. At this time, the feed bars 6 are released from the advancement and return drive pins 27 and feed bar clamping and unclamping carriers 28. Thereafter, when the feed bars 6 and grip fingers 6*a* thereon are displaced forwardly of the press as shown by the dot lines in FIG. 1 (or rearwardly), the dies 29 can be also taken out of the press together with the feed bars 6. When the dies 29 are desired to be reinstated to the operation position within the press, the above-mentioned procedure order is reversed.

In this way, the feed bars 6 release or unclamp the upper dies in a position adjacent to the bottom dead center of the stroke of the press crank and the press is then disposed in the position of crank angle 290°. Thus, with the press at this crank angle, the feed bars are prevented from performing the clamping and unclamping movements, but allowed to perform advancement and return movements. When the dies are replaced, it is essential that the feed bars 6 are precisely positioned on the lower die set plate 31. For the purpose, the unclamping position of the feed bars is divided into the two stages, that is, the intermediate unclamping position and fully open position. When the feed bars are set in the intermediate unclamping position, the bars are allowed to perform advancement and return movements. On the other hand, in the fully open unclamping position, the feed bars can be positioned with respect to the dies.

In order to obtain the intermediate and fully open unclamping positions for the feed bars, the oil pressure cylinder 4 is mounted on the bracket 2 which is in turn secured to the crown 1 and the lever 3 is pivoted at one end to the bracket 2 in a position below the oil cylinder 4. When air pressure is introduced into the lower chamber within the clamping cylinder 5 to cause the lever 3 to pivot upwardly until the lever abuts against the oil pressure cylinder whereupon the intermediate unclamping position of the feed bars is established. Thereafter, when air pressure is released from the oil pressure cylinder 4 and the feed bars 6 are opened by the degree corresponding to the stroke distance of the oil pressure cylinder 4, the fully open unclamping position is established.

Figure 6A:
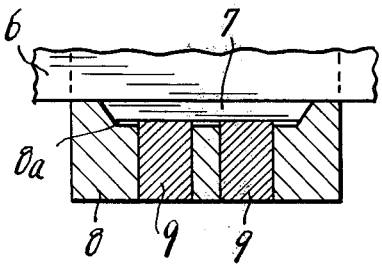
FIG. 6A is a fragmentary front elevational view in cross-section of said transfer press showing the feed bars in their fully open unclamping position.
Figure 6B:
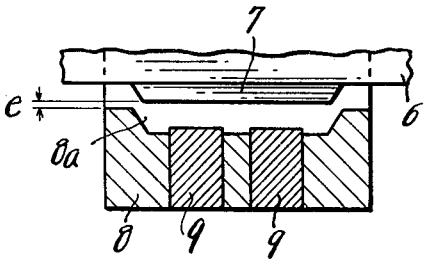
FIG. 6B is similar to FIG. 6A, but shows the feed bars in their intermediate unclamping position.
Figure 7:
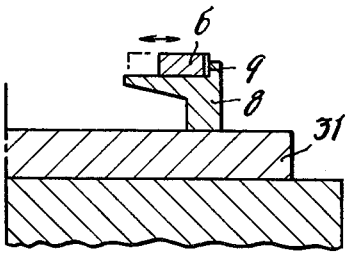
FIG. 7 is a side elevational view in longitudinal section showing the manner in which the feed bars are supported.

In order to position the feed bars 6, the positioning steel plates 7 are secured to the feed bars 6 as more clearly shown in FIGS. 6A and 6B and the feed bar carriers 8 are formed with grooves 8*a* into which the steel plates 7 are adapted to be received when the feed bars 6 have been moved to the fully open unclamping position. The magnets 9 are embedded in the feed bar carriers 8 to attract the steel positioning plates 7 for holding the feed bars 6 and lower die set plate 31 together so that the feed bars 6 can be prevented from displacing during the die taking-out and reinstating operations. When the feed bars 6 are in the intermediate unclamping position, the feed bars can move laterally because there is present the space e between each feed bar carrier 8 and the associated positioning steel plate 7.

Referring now to FIGS. 9A, 9B, 9C, 9D and 9E, the cam 11 mounted on the press slide 10 rocks the lever 3 upwardly and downwardly through the roller 12 as the slide 10 moves upwardly and downwardly and such rocking movement of the lever 3 in turn moves the rack 17 upwardly and downwardly through the pin 13 and connection rod 14 to thereby allow the feed bars 6 to effect clamping and unclamping.

Figure 8:
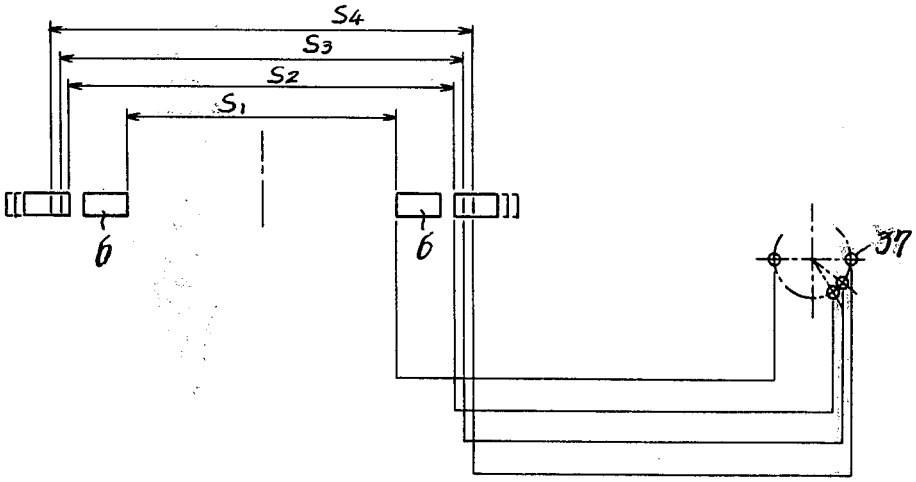
FIG. 8 is a diagram showing the relationship between different positions of the feed bars and different positions of the eccentric drive pin.
Figure 9A:
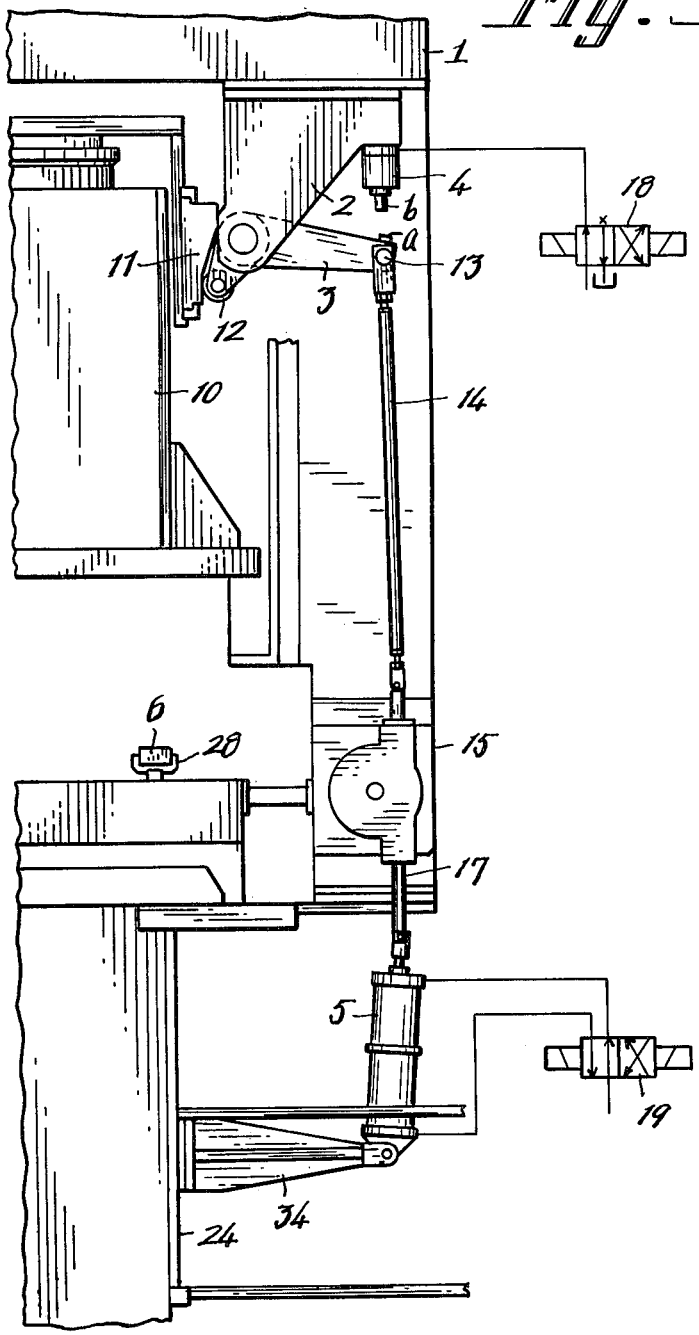
Figure 9C:
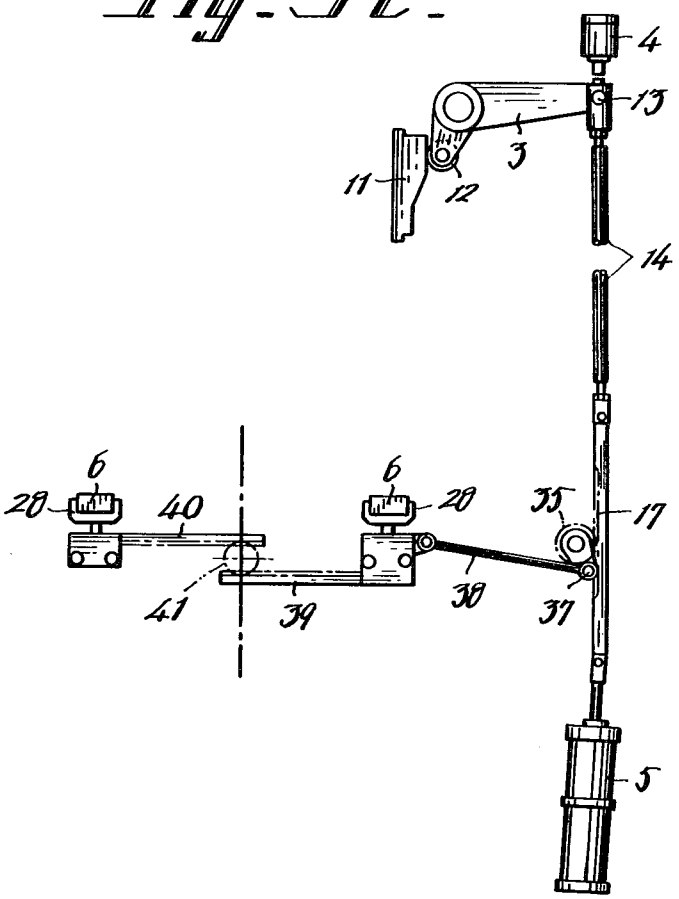
Figure 9B:
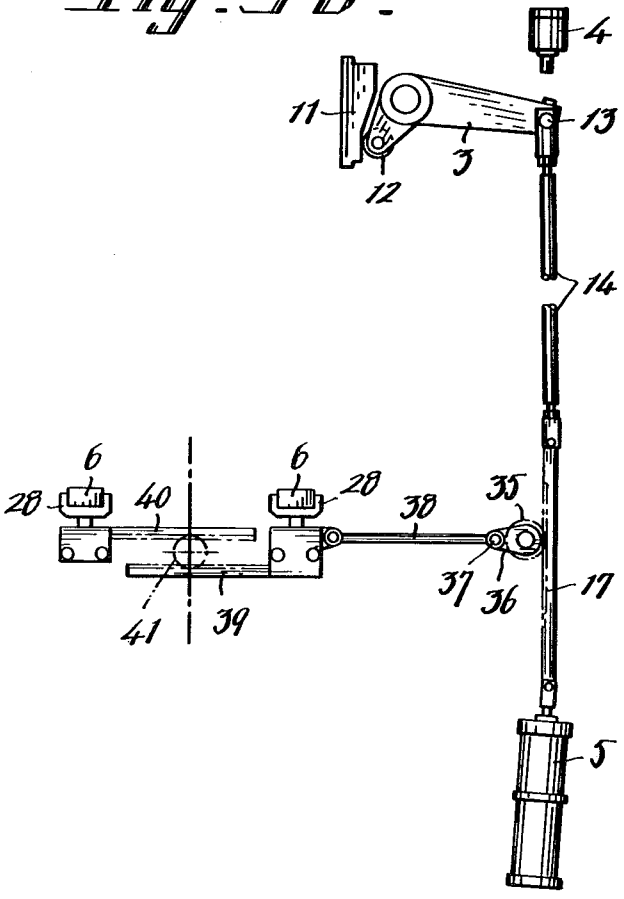
Figure 9E:
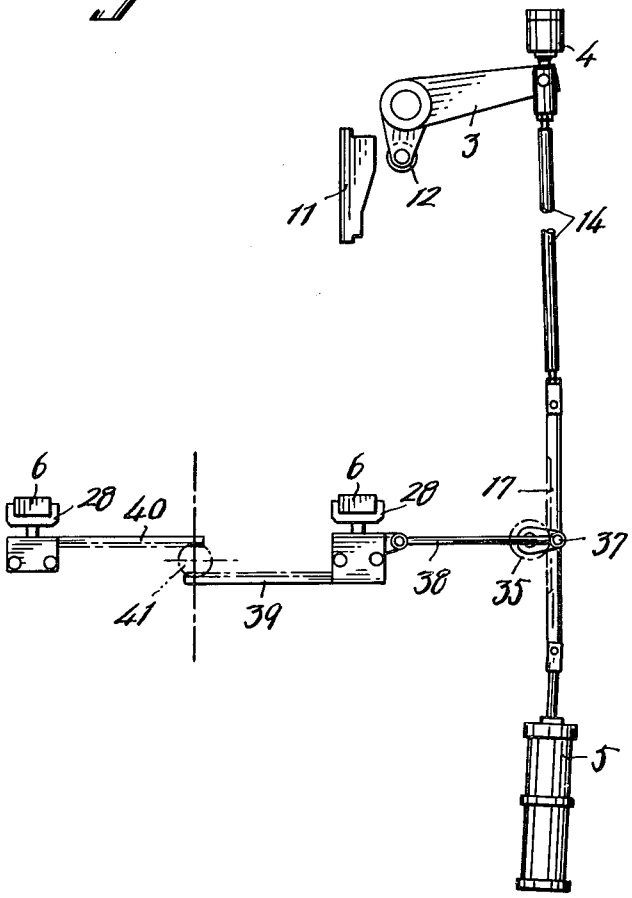
Figure 9D:
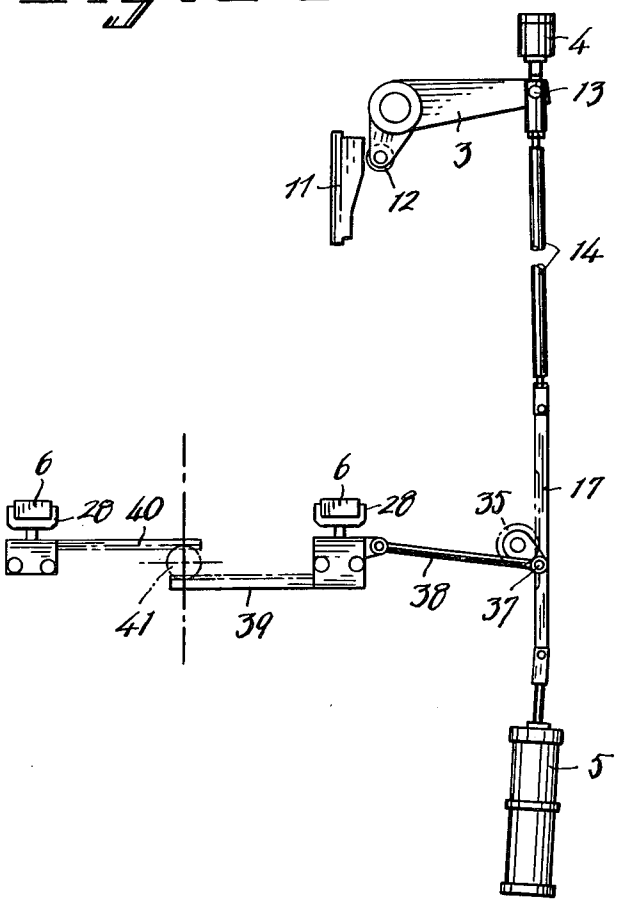

FIG. 8 shows the relationship between the feed bars 6 in different positions and the eccentric drive pin 37 in different positions. In FIG. 8, $S_1$ is the distance between the feed bars 6 in the clamping position, $S_2$ is the distance between the feed bars in the unclamping position, $S_3$ is the distance between the feed bars in the intermediate unclamping position and $S_4$ is the distance between the feed bars in the fully open unclamping position.

The operation of the oil pressure cylinder 4 and clamping cylinder 5 will be now described. Assuming that the oil pressure cylinder 4 has the stroke of 25 mm, then when the feed bars are set in the intermediate unclamping position and air is released from the oil pressure cylinder 4, the rack 17 moves by the distance of 25 mm, for example, to thereby move the feed bars 6 to the fully open unclamping position whereupon the positioning steel plates 7 for the feed bars 6 are attracted to the magnets 9 embedded in the feed bar carriers 8 to enter the grooves 8*a* in the carriers whereby the feed bars 6 are held in position.

The clamping cylinder 5 is normally supplied air pressure to the upper chamber of thereof, but when the feed bars 6 are to be moved to the unclamping position, the clamping cylinder 5 is supplied with air pressure at the lower chamber thereof whereby the rack 17 moves upwardly and the feed bars 6 are moved to the unclamping position. At this time, the upper end a of the lever 3 abuts against the piston rob b of the oil pressure cylinder 4 whereupon the feed bars 6 are set in the intermediate unclamping position. With the feed bars 6 in the intermediate unclamping position, when the press slide 10 is moved, the feed bars 6 can effect only advancement and return movements.

According to the present invention, when the die change device is provided with a die lifting means and a means for moving the dies forwardly and backwardly, by merely mounting the oil pressure cylinder 4 and feed bar positioning steel plates 7 on the conventional transfer press and embedding the magnets 9 in the feed bar carriers 8, the placement and removal of the feed bars into and out of the press as well as the movement of the dies can be performed by only button manipulation without requiring any manual operation. Thus, the present invention can attain improvement of press operation efficiency, reduction of burden on operators and enhancement of safety factor.

While only one embodiment of the invention has been shown and described in detail, it will be understood that the same is for illustration purpose only and not to be taken as a definition of the invention, reference being had for this purpose to the appended claim.

I claim:

1. A die change device in a transfer press comprising a pivotal lever pivoted to a bracket of said press and in engagement with a cam on the slide of the press for moving a rack upwardly and downwardly, an oil pressure cylinder mounted on said bracket about said lever, a clamping cylinder connected to the lower end of said rack, a pair of feed bars adapted to be driven by said rack to effect clamping and unclamping movements, a clamp drive unit for imparting advancement and return movements to said feed bars, a positioning plate secured to each of said feed bars for carrying the associated feed bar, a positioning plate carrier mounted below each said feed bar and a magnet embedded in each of said feed bar carriers to cooperate with the associated positioning plate, whereby said feed bars are positioned in intermediate and fully open unclamping positions by said oil pressure cylinder and clamping cylinder, thereby enabling said feed bars together with a die to move out of the press.

* * * * *